US009356366B2

(12) United States Patent
Moore

(10) Patent No.: US 9,356,366 B2
(45) Date of Patent: May 31, 2016

(54) CABLE CONNECTOR ASSEMBLY FOR A COMMUNICATION SYSTEM

(71) Applicant: Tyco Electronics Corporation, Berwyn, PA (US)

(72) Inventor: Jerry Lee Moore, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 64 days.

(21) Appl. No.: 14/260,868

(22) Filed: Apr. 24, 2014

(65) Prior Publication Data

US 2015/0311605 A1 Oct. 29, 2015

(51) Int. Cl.

*H01R 12/00* (2006.01)
*H01R 9/05* (2006.01)
*H01R 12/53* (2011.01)

(52) U.S. Cl.

CPC ..... *H01R 9/0515* (2013.01); *H01R 12/53* (2013.01)

(58) Field of Classification Search

CPC ..... H01R 9/0515; H01P 5/085
USPC ..... 439/63, 581, 578, 916
See application file for complete search history.

(56) References Cited

U.S. PATENT DOCUMENTS 3,383,457 A * 5/1968 Schumacher ..... H01R 4/185 174/261
3,514,737 A * 5/1970 Renshaw, Jr. ..... H01R 9/0515 439/63
3,689,865 A * 9/1972 Pierini ..... H01P 5/085 439/581
4,222,056 A * 9/1980 Graeser, Jr. ..... H01Q 13/10 174/75 C
4,656,441 A * 4/1987 Takahashi ..... H01P 5/085 333/260
5,268,700 A * 12/1993 Hirotsu ..... H01Q 1/1271 343/713
6,164,984 A * 12/2000 Schreiner ..... H01Q 1/1271 439/86
6,264,475 B1 7/2001 Machado
7,029,321 B2 4/2006 Sato et al.
7,909,646 B2 3/2011 Feldman et al.
8,368,613 B2 * 2/2013 Hornung ..... H01Q 1/1207 343/702
2012/0115358 A1 5/2012 Chiu

FOREIGN PATENT DOCUMENTS

JP 8130404 A 10/1994

* cited by examiner

*Primary Examiner* — Hien Vu

(57) ABSTRACT

A cable connector assembly includes a carrier having an insulative sheet with a substrate side fixedly mounted to a substrate and a contact side opposite the substrate side. A first conductive contact is secured to the contact side of the carrier. The first conductive contact has a pad coupled to a center conductor of a cable and a spring beam extending from the pad of the first conductive contact. The spring beam of the first conductive contact is resiliently deformed against a corresponding printed electronic on the substrate. A second conductive contact is secured to the contact side of the carrier. The second conductive contact has a pad coupled to an outer conductor of the cable and a spring beam extending from the pad of the second conductive contact. The spring beam of the second conductive contact is resiliently deformed against a corresponding printed electronic on the substrate.

19 Claims, 2 Drawing Sheets

CABLE CONNECTOR ASSEMBLY FOR A COMMUNICATION SYSTEM

BACKGROUND OF THE INVENTION

The subject matter herein relates generally to cable connector assemblies, such as a coaxial cable connector assembly, for electrical systems such as communication systems.

Electrical systems, such as those for use in communication systems, have a wide variety of applications including voice communication, data communication, and the like. For example, wireless communication systems may be used to communicate between cell phone towers and a mobile phone. Wireless communication systems may be used to transfer data wirelessly between a router and a computer. Other examples of wireless communication systems include global positioning systems (GPS), radio systems, personal digital assistants (PDAs), cell phones, data networks such as wireless local area networks (LANs), and the like. Such communication systems typically include an antenna coupled to a wireless device by a cable. Size constraints due to miniaturization demand ultra-small, or micro, coaxial interconnects.

In systems today, a small terminal is crimped to the cable, which is inserted into a connector of the device. Such connectors and terminals add to the overall cost of the system. In other systems, the coaxial cable is connected to the antenna or other electronics using solder or a conductive epoxy connection. Due to the small size of the micro-coaxial cable, the application of epoxy or adhesive is difficult and unreliable. Additionally, with some applications, soldering of the cable to the antenna or other electronics is impractical or impossible. For example, with printed electronics, which are printed directly on a substrate by an additive process, the soldering process may destroy the printed circuits due to the high temperature of the soldering process.

A need remains for a cable connector assembly that may be electrically connected to a printed circuit in a cost effective and reliable manner.

BRIEF SUMMARY OF THE INVENTION

In one embodiment, a cable connector assembly is provided including a carrier having an insulative sheet having a substrate side configured to be mounted to a substrate and a contact side opposite the substrate side. A first conductive contact is secured to the contact side of the carrier. The first conductive contact has a pad configured to be coupled to a center conductor of a cable and a spring beam extending from the pad of the first conductive contact. The spring beam of the first conductive contact is configured to be resiliently deformed against a corresponding printed electronic on the substrate. A second conductive contact is secured to the contact side of the carrier. The second conductive contact has a pad configured to be coupled to an outer conductor of the cable and a spring beam extending from the pad of the second conductive contact. The spring beam of the second conductive contact is configured to be resiliently deformed against a corresponding printed electronic on the substrate.

Optionally, the pad of the first and second conductive contacts may define solder pads configured to be soldered to the center conductor and outer conductor, respectively. The pads may be secured to the carrier by adhesive. The pad of the first conductive contact may include a protrusion supporting the center conductor along a central longitudinal axis of the cable.

Optionally, the spring beams may each have separable interfaces configured to engage the corresponding printed electronics. The insulative sheet may include a window therethrough and the spring beam of the second conductive contact may extend into the window to engage the corresponding printed electronic.

Optionally, the insulative sheet may control the spacing of the first and second conductive contacts to position the spring beam of the first conductive contact relative to the spring beam of the second conductive contact. The substrate side of the insulative sheet may have an adhesive layer for securing the carrier to the substrate.

In another embodiment, a coaxial connector assembly is provided that includes a coaxial cable and a contact assembly coupled to part of the coaxial cable. The coaxial cable includes a center conductor, a dielectric surrounding the center conductor, an outer conductor surrounding the dielectric, and a jacket surrounding the outer conductor. The contact assembly includes a carrier having an insulative sheet having a substrate side configured to be mounted to a substrate and a contact side opposite the substrate side. A first conductive contact is secured to the contact side of the carrier. The first conductive contact has a pad configured to be coupled to a center conductor of a coaxial cable and a spring beam extending from the pad of the first conductive contact. The spring beam of the first conductive contact is configured to be resiliently deformed against a corresponding printed electronic on the substrate. A second conductive contact is secured to the contact side of the carrier. The second conductive contact has a pad configured to be coupled to an outer conductor of a coaxial cable and a spring beam extending from the pad of the second conductive contact. The spring beam of the second conductive contact is configured to be resiliently deformed against a corresponding printed electronic on the substrate.

In a further embodiment, a communication system is provided that includes a substrate having a first printed electronic and a second printed electronic printed on a surface of the substrate. A contact assembly is mounted to the substrate. The contact assembly includes a carrier having an insulative sheet having a substrate side configured to be mounted to a substrate and a contact side opposite the substrate side. A first conductive contact is secured to the contact side of the carrier. The first conductive contact has a pad configured to be coupled to a center conductor of a coaxial cable and a spring beam extending from the pad of the first conductive contact. The spring beam of the first conductive contact is configured to be resiliently deformed against a corresponding printed electronic on the substrate. A second conductive contact is secured to the contact side of the carrier. The second conductive contact has a pad configured to be coupled to an outer conductor of a coaxial cable and a spring beam extending from the pad of the second conductive contact. The spring beam of the second conductive contact is configured to be resiliently deformed against a corresponding printed electronic on the substrate.

DETAILED DESCRIPTION OF SPECIFIC EMBODIMENTS OF THE INVENTION

Figure 1:
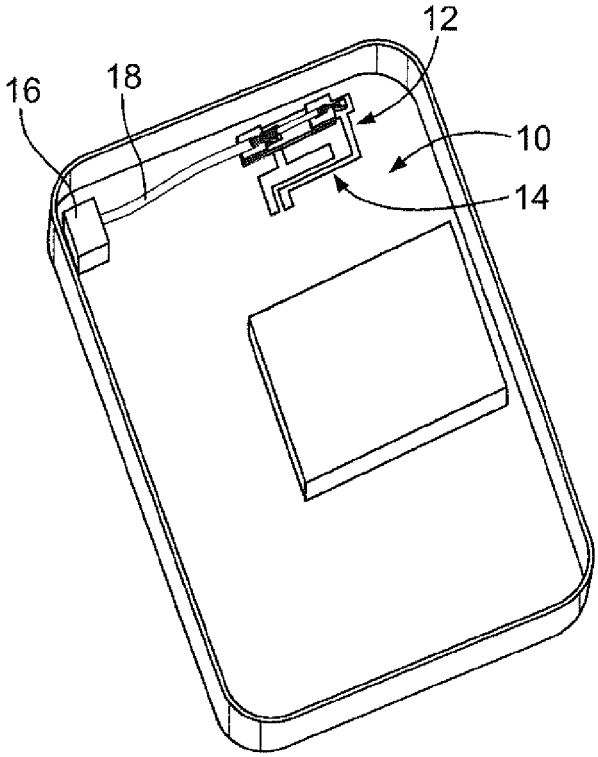
FIG. 1 illustrates a communication system formed in accordance with an exemplary embodiment.

FIG. 1 illustrates an electrical system 10 such as a communication system formed in accordance with an exemplary embodiment. The communication system 10 includes a communication circuit 12. Optionally, the communication system 10 may perform as the wireless communication system component of a wireless device, and the communication circuit 12 may include an antenna to communicate wirelessly with other devices. The wireless device may be any type of wireless device, such as a cellular handset, a mobile antenna, a GPS, a radio system, a PDA, or another type of wireless communication system, such as a wireless LAN. The communication system 10 may be another type of system in alternative embodiments, such as a network or other device that communicates through wired communication as opposed to wireless communication.

In the illustrated embodiment, the communication system 10 is a wireless system that includes an antenna 14 connected to a wireless device component 16 by a cable 18. The cable 18 is connected to the communication circuit 12 (including antenna 14) by a coaxial connector assembly 50. The wireless device component 16 is illustrated in FIG. 1 schematically, and may include any structural features depending on the particular application (for example, component 16 may be a wireless transceiver chip). The cable 18, such as a coaxial cable, connecting the wireless device 16 and the antenna 14 may have any suitable length. The antenna 14 forms part of the communication circuit 12. In alternative embodiments, the communication circuit 12 may not include the antenna 14, but rather includes traces interconnecting the cable 18 with another electronic component.

Figure 3:
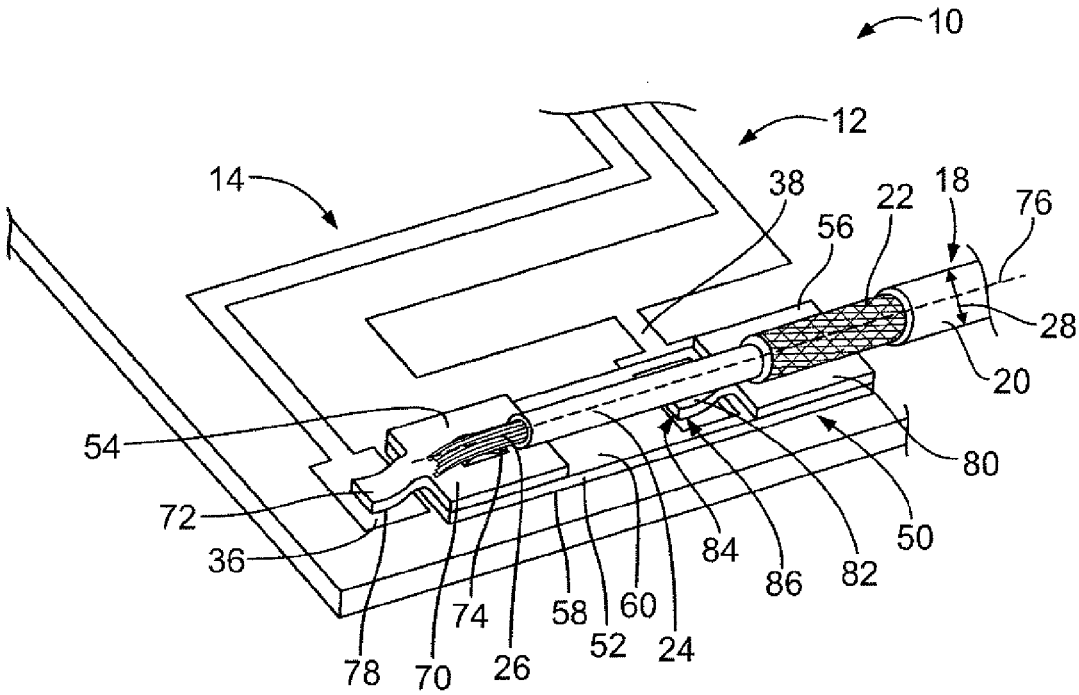
FIG. 3 illustrates the coaxial connector assembly coupled to the communication circuit.
Figure 2:
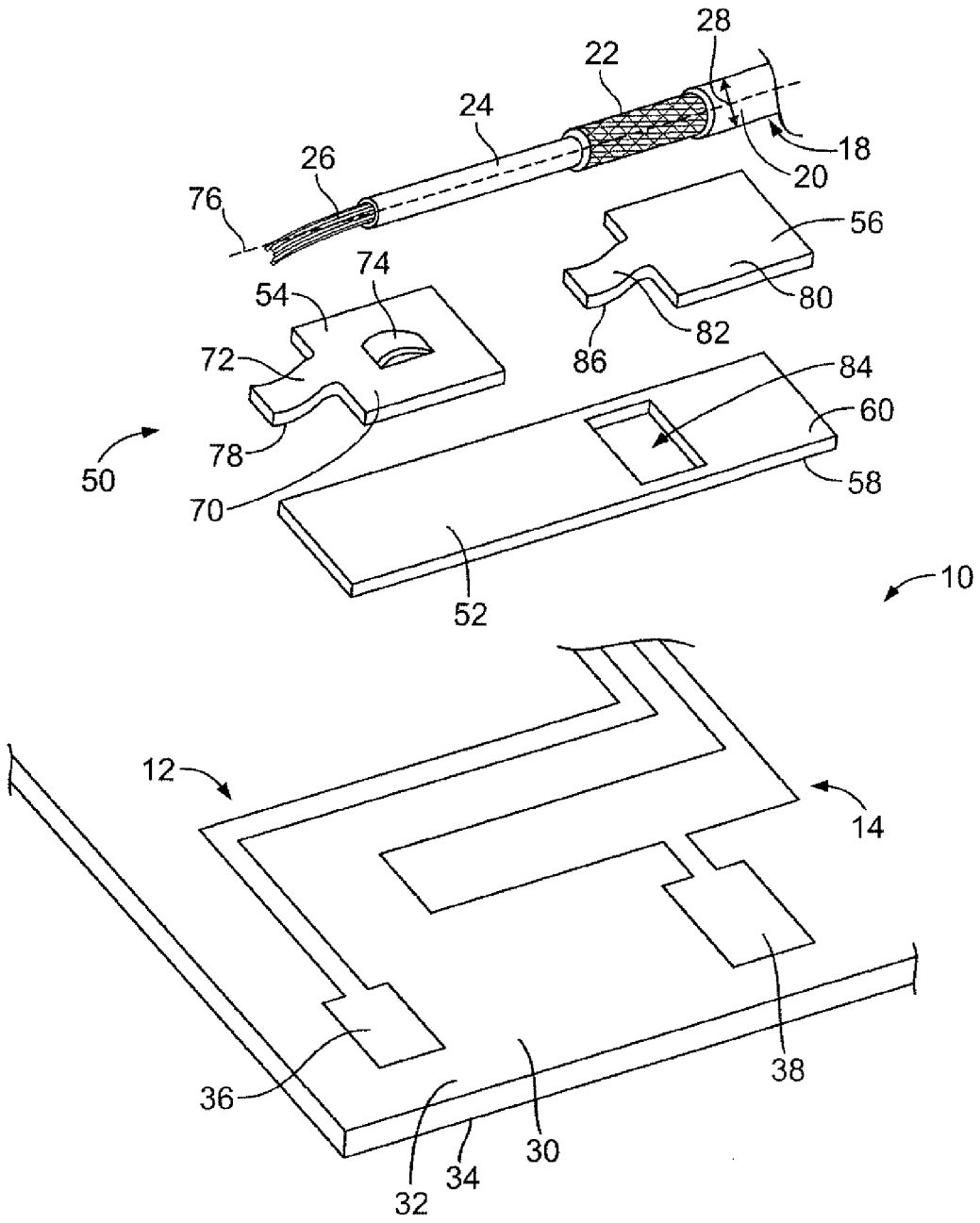
FIG. 2 is an exploded view of the communication system showing a coaxial connector assembly formed in accordance with an exemplary embodiment and poised for mounting to a communication circuit.

FIG. 2 is an exploded view of the communication system 10, showing the cable connector assembly 50 poised for mounting to the communication circuit 12. FIG. 3 illustrates the cable connector assembly 50 coupled to the communication circuit 12. The cable connector assembly 50 may be utilized with various types of electronic devices and the device illustrated in the figures is merely illustrative of one exemplary embodiment.

According to a specific embodiment, the cable 18 is a coaxial cable having an outer insulative jacket 20, an outer conductor 22, such as a cable braid, a dielectric 24 and a center conductor 26, which may be multiple stranded conductors or a solid conductor. The dielectric 24 surrounds the center conductor 26 and isolates the center conductor 26 from the outer conductor 22. The outer conductor 22 circumferentially surrounds the dielectric 24. The outer conductor 22 provides electrical shielding for the center conductor 26. The outer jacket 20 circumferentially surrounds the outer conductor 22 and defines the outer surface of the cable 18. The cable 18 has a diameter 28 defined by the outer jacket 20. In an exemplary embodiment, the cable 18 is a micro-coaxial cable having a small diameter 28. For example, the diameter 28 may be less than 1 mm. Other diameters are possible in alternative embodiments.

The communication circuit 12, including the antenna 14, is provided on a substrate 30 having a first surface 32 and a second surface 34 opposite the first surface 32. The substrate 30 may be rigid according to the specific embodiment. In other embodiments, the substrate may be flexible. The substrate 30 may be part of a device, such as a handheld device or a computing device. For example, the substrate 30 may be part of a cellular device, a GPS, a radio system, or another type of wireless device. The substrate 30 may be a case or frame of the device. The substrate 30 may be a component within the device, such as a glass surface of a display of the device.

The communication circuit 12 includes printed electronics 36, 38 on the first surface 32 of the substrate 30. The printed electronics 36, 38 may be printed directly on the first surface 32. The printed electronics 36, 38 may be built-up on the substrate 30, such as by an additive process. For example, a conductive layer may be printed on the first surface 32 in a certain pattern. The conductive layer may define a seed layer that is later processed, such as by plating, for example electroplating, to build up thicker conductive circuit layers that define the printed electronics 36, 38. Such additive process is in contrast to conventional printed circuits that have traces formed by subtractive processes on layers of boards that are etched from copper sheets laminated on non-conductive board layers. Such traditional laminated boards are unfit for use in certain applications, such as for use as a case or frame of a device or for use as the glass of a touch screen. The traditional boards are separate components that are received and held in the device and require extra space within the device to accommodate such boards. In contrast, the printed electronics 36, 38 may be applied to existing structures of the device, such as the case, screen or other parts of the device, which may save space and allow the device to be made smaller or to include additional components within the same space or envelope.

In an exemplary embodiment, the printed electronics 36, 38 define, or provide conductive traces and/or pads to, a signal element and a ground element, respectively, on the first surface 32. The printed electronics 36 and/or 38 may be substantially transparent for applications where the substrate is glass or other transparent rigid plastic. The positioning of the signal and ground printed electronics 36, 38 along the first surface 32 may be selected to control electrical characteristics and properties of the antenna 14. Similarly, the lengths and widths of the signal and ground printed electronics 36, 38 may be selected to control the electrical characteristics of the antenna 14. The spacing between the signal and ground printed electronics 36, 38 may be selected to control electrical characteristics of the antenna 14. The overall size, shape, and thickness of the substrate 30 may also be selected to control the electrical characteristics of the antenna 14. The signal and ground printed electronics 36, 38 may be deposited on the first surface 32, such as by a screen printing process, an inkjet process, or another printing process, which may be enhanced by a plating process, such as an electroplating process to thicken or increase the amount of conductive material defining the printed electronics 36, 38.

The communication system 10 includes a cable connector assembly 50 used to electrically connect the cable 18 to the communication circuit 12 or directly to antenna 14. The cable connector assembly 50 is mechanically secured to the substrate 30. The cable connector assembly 50 is electrically connected to the printed electronics 36, 38 without soldering to the printed electronics 36, 38. The cable connector assembly 50 is electrically connected to the printed electronics 36, 38 at a resilient and compressible interface.

The cable connector assembly 50 includes a carrier 52 that holds a first conductive contact 54 and a second conductive contact 56. The carrier may hold any number of contacts. Optionally, the carrier 52 may be an insulative sheet having a substrate side 58 configured to be mounted to the substrate 30 and a contact side 60 opposite the substrate side 58. The insulative sheet, which may for example be made of a polyimide material or the like, may be flexible. Alternatively, the sheet may be rigid or semi-rigid. The carrier 52 may be a film in alternative embodiments. The carrier 52 may be a board or another structure in other alternative embodiments. The carrier 52 may be secured to the substrate 30 by adhesive, such as an adhesive layer, formed on the substrate side 58. The carrier 52 may be secured to the substrate 30 by other means in alternative embodiments, such as epoxy, fasteners, and the like.

The first contact 54 is secured to the contact side 60 of the carrier 52. The first contact 54 may be secured to the carrier 52 by adhesive, epoxy, fasteners, and the like. The first contact 54 has a conductive pad 70 mounted to the carrier 52. The pad 70 is configured to be coupled to, such as terminated to, the center conductor 26 of the coaxial cable 18. For example, the pad 70 may define a solder pad that is soldered to the center conductor 26. Alternatively, the pad 70 may be coupled to the center conductor 26 by other means, such as a crimp connection, an insulation displacement connection, and the like. In an exemplary embodiment, the pad 70 may be a stamped metal piece that includes a dimple or protrusion 74. The center conductor 26 may be coupled to, such as terminated to, the protrusion 74. The pad 70 may be terminated to any part or portion of the center conductor 26 of the cable 18, such as at or near the end or along another portion of the cable 18. The protrusion 74 may be formed by coining or stamping a portion of the pad 70. The protrusion 74 is elevated above the pad 70 to support the center conductor 26 along a central longitudinal axis 76. As such, the center conductor 26 does not need to be bent downward toward the pad 70 for termination. Rather, the center conductor 26 can extend along the axis 76. For example, because the center conductor 26 has a smaller diameter as compared to the outer conductor 22, the first contact 54 is thicker or elevated to support the center conductor 26.

The first contact 54 has a spring beam 72 extending from the pad 70. The spring beam 72 is configured to be resiliently deformed against the corresponding printed electronic 36 on the substrate 30. The spring beam 72 extends off of the carrier 52, such as beyond an edge of the carrier 52 to mate with the printed electronic 36. The spring beam 72 may extend in any direction from the pad 70 to correspond to a location of the printed electronic 36 relative to the carrier 52. When the carrier 52 is mounted to the substrate 30, the spring beam 72 is deflected against the substrate 30 and printed electronic 36 to elastically deform the spring beam 72. The spring beam 72 is thus deflected or compressed against the printed electronic 36 to ensure that an adequate electrical connection is made with the printed electronic 36. The spring beam 72 has a separable interface 78 that engages the printed electronic 36. The electrical connection is made without the need for solder to avoid the excessive heating of the printed electronics 36, which could damage the printed electronics.

The second contact 56 is secured to the contact side 60 of the carrier 52. The second contact 56 may be secured to the carrier 52 by adhesive, epoxy, fasteners, and the like. The second contact 56 has a conductive pad 80 mounted to the carrier 52. The pad 80 is configured to be coupled to, such as terminated to, the outer conductor 22 of the coaxial cable 18. For example, the pad 80 may define a solder pad that is soldered to the outer conductor 22. Alternatively, the pad 80 may be coupled to, such as terminated to, the outer conductor 22 by other means, such as a crimp connection, an insulation displacement connection, and the like.

The second contact 56 may be a stamped metal piece that has a formed spring beam 82 extending from the pad 80. The spring beam 82 is configured to be resiliently deformed against the corresponding printed electronic 38 on the substrate 30. The spring beam 82 extends off of the carrier 52 to mate with the printed electronic 38. For example, the carrier 52 includes a window 84 therethrough aligned with the second printed electronic 38 and the spring beam 82 extends into the window 84 to mate directly with the printed electronic 38. Alternatively, the spring beam 82 may extend from a side of the carrier 52 to connect to the printed electronic 38 without use of a window 84. The spring beam 82 may extend in any direction from the pad 80 to correspond to a location of the printed electronic 38 relative to the carrier 52. When the carrier 52 is mounted to the substrate 30, the spring beam 82 is deflected against the substrate 30 and printed electronic 38 to elastically deform the spring beam 82. The spring beam 82 is thus deflected or compressed against the printed electronic 38 to ensure that an adequate electrical connection is made with the printed electronic 38. The spring beam 82 has a separable interface 86 that engages the printed electronic 38. The electrical connection is made without the need for solder to avoid the excessive heating of the printed electronics 38, which could damage the printed electronics.

During assembly the cable connector assembly 50 is assembled and then mounted to the substrate 30. For example, the contacts 54, 56 may be secured to the carrier 52 and then the cable 18 may be positioned on the carrier 52 and terminated or otherwise coupled to the contacts 54, 56. Alternatively, the contacts 54, 56 may be pre-terminated to the cable 18 and then attached to the carrier 52. As such, the spacing between the contacts 54, 56 need not be precisely controlled. Once the cable 18 is connected to the contacts 54, 56, the cable connector assembly 50 may be secured to the substrate 30, such as by adhesive. The adhesion of the carrier 52 to substrate 30 provides sufficient hold down force to hold the spring beams 72, 82 of the contacts 54, 56 in electrical connection with the printed electronics 36, 38. The carrier 52 is sized to ensure that the carrier has sufficient hold down force. Especially when the window 84 is provided, the carrier 52 controls the spacing between the contacts 54, 56 to position the spring beam 72 of the first contact 54 relative to the spring beam 82 of the second contact 56 for connection of the contacts 54, 56 to the printed electronics 36, 38.

Optionally, the cable connector assembly 50 may include a strain relief element (not shown) secured to the outer jacket 20 and/or dielectric 24 to provide strain relief for the connections to the contacts 54, 56. For example, the outer jacket 20 and/or dielectric 24 may be secured to the carrier 52 by adhesive, a strap, a fastener, a crimp connection, and the like. The strain relief element helps to maintain a relative position of the cable 18 with respect to the carrier 52.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A cable connector assembly comprising:

a carder comprising an insulative sheet having a substrate side configured to be mounted to a substrate and a contact side opposite the substrate side;

a first conductive contact secured to the contact side of the carrier, the first conductive contact having a pad configured to be coupled to a center conductor of a cable and a deflectable spring beam extending outwardly from the pad of the first conductive contact and toward the substrate, the deflectable spring beam of the first conductive contact being configured to be resiliently deformed against a corresponding printed electronic on the substrate; and a second conductive contact secured to the contact side of the carrier and spaced apart from the first conductive contact, the second conductive contact having a pad configured to be coupled to an outer conductor of the cable and a deflectable spring beam extending outwardly from the pad of the second conductive contact and toward the substrate, the deflectable spring beam of the second conductive contact being configured to be resiliently deformed against another corresponding printed electronic on the substrate;

wherein the spring beams each have separable interfaces configured to engage and be spring biased against the corresponding printed electronics.

2. The cable connector assembly of claim 1, wherein the pad of the first and second conductive contacts are configured to be soldered to the center conductor and outer conductor, respectively.

3. The cable connector assembly of claim 1, wherein the pads are secured to the carrier by adhesive.

4. The cable connector assembly of claim 1, wherein the insulative sheet controls the spacing of the first and second conductive contacts to position the spring beam of the first conductive contact relative to the spring beam of the second conductive contact.

5. The cable connector assembly of claim 1, wherein the insulative sheet is generally planar, the substrate side of the insulative sheet has an adhesive layer for securing the carrier to the substrate.

6. The cable connector assembly of claim 1, wherein the insulative sheet includes a window therethrough, the spring beam of the second conductive contact extending into the window to engage the corresponding printed electronic.

7. The cable connector assembly of claim 1, wherein the pad of the first conductive contact is generally planar and includes a protrusion extending outwardly therefrom, the center conductor being supported by the protrusion along a central longitudinal axis of the cable.

8. A coaxial connector assembly comprising:

a coaxial cable comprising a center conductor, a dielectric surrounding the center conductor, an outer conductor surrounding the dielectric, and a jacket surrounding the outer conductor; and a contact assembly coupled to part of the coaxial cable, the contact assembly comprising:

a carder comprising a generally planar insulative sheet having a substrate side configured to be mounted to a substrate and a contact side parallel to and opposite the substrate side;

a first conductive contact secured to the contact side of the carrier, the first conductive contact having a generally planar pad coupled to the center conductor of the coaxial cable and a deflectable spring beam extending outwardly from the pad of the first conductive contact toward the substrate, the deflectable spring beam of the first conductive contact being configured to be resiliently deformed and spring biased against a corresponding printed electronic on the substrate; and a second conductive contact secured to the contact side of the carrier, the second conductive contact having a generally planar pad coupled to the outer conductor of the coaxial cable and a deflectable spring beam extending outwardly from the pad of the second conductive contact toward the substrate, the deflectable spring beam of the second conductive contact being configured to be resiliently deformed and spring biased against another corresponding printed electronic on the substrate.

9. The coaxial connector assembly of claim 8, wherein the pad of the first and second conductive contacts are configured to be soldered to the center conductor and the outer conductor, respectively.

10. The coaxial connector assembly of claim 8, wherein the spring beams each have separable interfaces configured to engage the corresponding printed electronics.

11. The coaxial connector assembly of claim 8, wherein the pads are secured to the carrier by adhesive.

12. The coaxial connector assembly of claim 8, wherein the insulative sheet controls the spacing of the first and second conductive contacts to position the spring beam of the first conductive contact relative to the spring beam of the second conductive contact.

13. The coaxial connector assembly of claim 8, wherein the substrate side of the insulative sheet has an adhesive layer for securing the carrier to the substrate.

14. A communication system comprising:

a substrate having a first printed electronic and a second printed electronic printed on a surface of the substrate; and a contact assembly mounted to the substrate, the contact assembly comprising:

a carrier comprising an insulative sheet having a substrate side mounted to the surface of the substrate and a contact side opposite the substrate side;

a first conductive contact secured to the contact side of the carrier, the first conductive contact having a pad configured to be coupled to a center conductor of a coaxial cable and a deflectable spring beam extending outwardly from the pad of the first conductive contact toward the substrate, the spring beam of the first conductive contact being resiliently deformed and spring biased against the first printed electronic on the substrate when the carrier is mounted to the surface of the substrate; and a second conductive contact secured to the contact side of the carrier, the second conductive contact having a pad configured to be coupled to an outer conductor of a coaxial cable and a deflectable spring beam extending outwardly from the pad of the second conductive contact toward the substrate, the spring beam of the second conductive contact resiliently deformed and spring biased against the second printed electronic on the substrate when the carrier is mounted to the surface of the substrate.

15. The communication system of claim 14, wherein the pad of the first and second conductive contacts are configured to be soldered to the center conductor and outer conductor, respectively.

16. The communication system of claim 14, wherein the spring beams each have separable interfaces directly engaging the corresponding printed electronics.

17. The communication system of claim 14, wherein the pads are secured to the carrier by adhesive.

18. The communication system of claim 14, wherein the insulative sheet controls the spacing of the first and second conductive contacts to position the spring beam of the first conductive contact relative to the spring beam of the second conductive contact.

19. The communication system of claim 14, wherein the substrate side of the insulative sheet has an adhesive layer for securing the carrier to the substrate.

* * * * *